United States Patent [19]

Elter

[11] Patent Number: 4,551,007

[45] Date of Patent: Nov. 5, 1985

[54] CONTROLLER FOR A FUSING DEVICE OF AN ELECTROPHOTOGRAPHIC PRINTING MACHINE

[75] Inventor: Michael R. Elter, Webster, N.Y.

[73] Assignee: Xerox Corporation, Stamford, Conn.

[21] Appl. No.: 609,179

[22] Filed: May 11, 1984

[51] Int. Cl.[3] ..... G03G 15/20

[52] U.S. Cl. ..... 355/14 FU; 219/216; 219/497; 355/3 FU

[58] Field of Search ..... 355/3 FU, 14 FU; 219/216, 492, 494, 497

[56] References Cited

U.S. PATENT DOCUMENTS

| | | | |
|---|---|---|---|
| 4,046,990 | 9/1977 | White | 219/471 |
| 4,145,599 | 3/1979 | Sakurai et al. | 219/216 |
| 4,318,612 | 3/1982 | Brannan et al. | 355/14 FU |
| 4,415,800 | 11/1983 | Dodge et al. | 219/497 |
| 4,496,829 | 1/1985 | Black et al. | 219/497 |

FOREIGN PATENT DOCUMENTS

| | | | |
|---|---|---|---|
| 0089879 | 7/1980 | Japan | 355/14 FU |
| 0070575 | 5/1982 | Japan | 355/14 FU |

*Primary Examiner*—A. T. Grimley
*Assistant Examiner*—J. Pendegrass
*Attorney, Agent, or Firm*—H. Fleischer; J. E. Beck; R. Zibelli

[57] ABSTRACT

An apparatus in which images on sheets are fused during a copy run. Heat is applied to at least the images on successive sheets advanced, in seriatim, through a fusing device permanently affixing the images to the sheet. The temperature of the fusing device is detected and a signal indicative thereof transmitted. A controller compares the time derivative of the signal received from the detector at initialization of the copy run to a first constant and energize the heater of the fusing device when the first constant is less than the time derivative of the signal. During the copy run, after the time derivative of the signal is less than the first constant, the controller compares the signal received from the detector to a constant and generates an error signal indicative of the difference therebetween to control the heater of the fusing device. After the copy run, the controller compares the time derivative of the signal received from the detector to still another constant and de-energizes the heater of the fusing device when this latter constant is less than the time derivative of the signal. Once the surface temperature of the fusing device returns to the stand-by temperature at the end of the copy run, the controller returns to comparing the signal received from the detector to a constant and generating an error signal indicative of the difference therebetween which regulates the heater thereof.

14 Claims, 5 Drawing Figures

CONTROLLER FOR A FUSING DEVICE OF AN ELECTROPHOTOGRAPHIC PRINTING MACHINE

This invention relates generally to fusing devices used in an electrophotographic printing machine, and more particularly concerns a control system employed therein for anticipating the temperature deviations of the fuser device and correcting for these deviations automatically.

Generally, an electrophotographic printing machine employs a photoconductive member which is charged to a substantial uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a latent powder image on the photoconductive member. The toner powder image is then transferred from the photoconductive member to a copy sheet. The toner particles are heated to permanently affix the powder image to the copy sheet.

In a commercial printing machine of the foregoing type, the fusing device employs a heated roller to heat the toner particles and permanently affix them to the copy sheet. However, it is necessary to insure that the toner particles do not adhere to the fuser roller. In the event that the toner particles adhere to the fuser roller, they may be subsequently transferred to successive copy sheets degradating the quality thereof. Thus, the fuser roller must operate within a temperature latitude dictated by the properties of the toner particles. At one extreme, the fuser roller must be heated sufficiently to permanently affix the toner particles to the copy sheet. While at the other extreme, the fuser roller temperature must not exceed the maximum limit wherein toner particles are offset from the copy sheet and remain adhering to the fuser controller.

Generally, the fuser roller is heated by a suitable heat source to a pre-determined temperature. At the surface of the roller, a temperature detecting device continuously measures the surface temperature of the roller. A control circuit associated with the temperature detector regulates the amount of power furnished to the heating element of the fuser roller so as to control the surface temperature thereof. It has been found that as the fuser roller contacts the copy sheet, the fuser roller surface temperature drops below the intended steady state operating temperature. This temperature drop is caused by both the lag in the temperature detector and the thermal mass of the fuser roll core. As the control systems responds to these lags, the fuser roll temperature increases to its operating temperature. However, after completion of a copy run, due to the thermal energy stored in the fuser roll and the lag in the temperature sensor, the surface temperature overshoots the designed steady state stand-by temperature. At some later time, the temperature returns to the steady state stand-by condition. Operation of the fusing system in this manner is inefficient and may produce copy quality defects. For example, the copies going through the fusing device initially may not be heated sufficiently to permanently affix the toner powder image to the sheet. Alternatively, temperature overshoots at the end of a copy run increase the temperatures at which the first few copies of the following job experience. This may lead to offsetting of the toner particles from the copy sheets to the fuser roll. Various approaches have been devised to control the temperature of fusing devices. The following disclosures appear to be relevant:

- U.S. Pat. No. 4,046,990 Patentee: White Issued: Sept. 6, 1977
- U.S. Pat. No. 4,145,599 Patentee: Sakurai Issued: Mar. 20, 1979
- U.S. Pat. No. 4,318,612, Patentee: Brannan, et al. Issued: Mar. 9, 1982
- U.S. Pat. No. 4,415,800 Patentee: Dodge, et al. Issued: Nov. 15, 1983

The pertinent portions of the foregoing disclosures may be briefly summarized as follows:

White discloses a heater roll disposed internally of a fuser roll with a temperature sensor contacting the core thereof. Upon energizing the printing machine, a controller detects the need to raise the core temperature, as measured by the temperature sensor, to an idle temperature. During a copy run, a selectively insertable resistor is added to the control circuit. With the addition of the resistor, the controller regulates at a pre-determined higher controlled setting. At this higher control setting, the heater is actuated until the core reaches the predetermined temperature appropriate for fusing in the run state. After the copy run is completed the resistor is removed from the circuit returning to the idle temperature.

Sakurai, et al., describes a thermister contacting the surface of a fuser roll and being also connected to a heat source. The thermister set-point temperature is variable. When the detected fuser temperature is less than the set-point temperature, the fuser is energized. The set-point temperature during copying is greater than the set-point temperature during stand-by. The stand-by set-point is greater than the set-point temperature after a copy run. This latter set-point temperature, in turn, is equal or greater than the set-point temperature during the waiting time. In this way, the temperature of the fuser roller is limited to a narrow range.

Brannan, et al., discloses a fuser roller temperature controller that adjusts the set-point temperatures so that at a cold start the set-point temperature is higher than for a relatively hot start. During copying, the fusing temperature set-point varies as a function of the area of the sheet to be fused. Larger sheets have a higher fuser temperature set-point with the set-point being reduced at specified intervals during the copy run.

Dodge, et al., describes a fuser roller temperature control system which monitors the fuser roll temperature during warm up. The fuser roll temperature is sampled for decreasing threshold intervals. Sampling terminates when the measured fuser roll temperature exceeds the threshold temperature. The copier is then enabled for normal copying.

In accordance with one aspect of the features of the present invention, there is provided an apparatus for fusing images to a sheet during a copy run. Means are provided for applying heat to at least the images on successive sheets advanced, in seriatum, thereto for substantially permanently affixing the images to the sheets. Means detect the temperature of the heat applying means and transmit a signal indicative thereof. Means control the heat applying means. The controlling means compares the time derivative of the signal received from the detecting means at initialization of the copy run to a first constant and energizes the heat applying means when the first constant is less than the time derivative of the signal. After the copy run, the controlling means compares the time derivative of the signal received from the detecting means to a second constant and de-energizes the heat applying means when the second constant is less than the time derivative of the signal. During the copy run, after the time derivative of the signal is less than the first constant and a specified time period has elapsed, the controlling means compares the signal from the detecting means to a third constant and generates an error signal indicative of the difference therebetween to control the heat applying means.

Pursuant to another aspect of the features of the present invention, there is provided an electrophotographic printing machine of the type having a fusing apparatus for fusing toner powder images transferred to copy sheets during a copy run of the printing machine. The improved fusing apparatus includes means for applying heat to at least toner images on successive sheets advanced, in seriatum, thereto for substantially permanently affixing the toner powder image to the copy sheets. Means detect the temperature of the heat applying means and transmits a signal indicative thereof. Means control the heat applying means. The controlling means compares the time derivative of the signal received from the detecting means at initialization of the copy run to a first constant and energizes the heat applying means when the first constant is less than the time derivative at the signal. After the copy run, the controlling means compares the time derivative of the signal received from the detecting means to a second constant and de-energizes the heat applying means when the second constant is less than the time derivative of the signal. During the copy run, after the time derivative of the signal is less than the first constant and a specified time period has elapsed, the controlling means compares the signal received from the detecting means to a third constant and generates an error signal indicative of the difference therebetween to control the heat applying means.

Other aspects of the invention will become apparent as the following description proceeds and upon reference to the drawings, in which.

While the present invention will hereafter be described in connection with a preferred embodiment thereof, it will be understood that it is not intended to limit the invention to that embodiment. On the contrary, it is intended to cover all alternatives, modification, and equivalents that may be included within the spirit and scope of the invention as defined by the appended claims.

Figure 1:
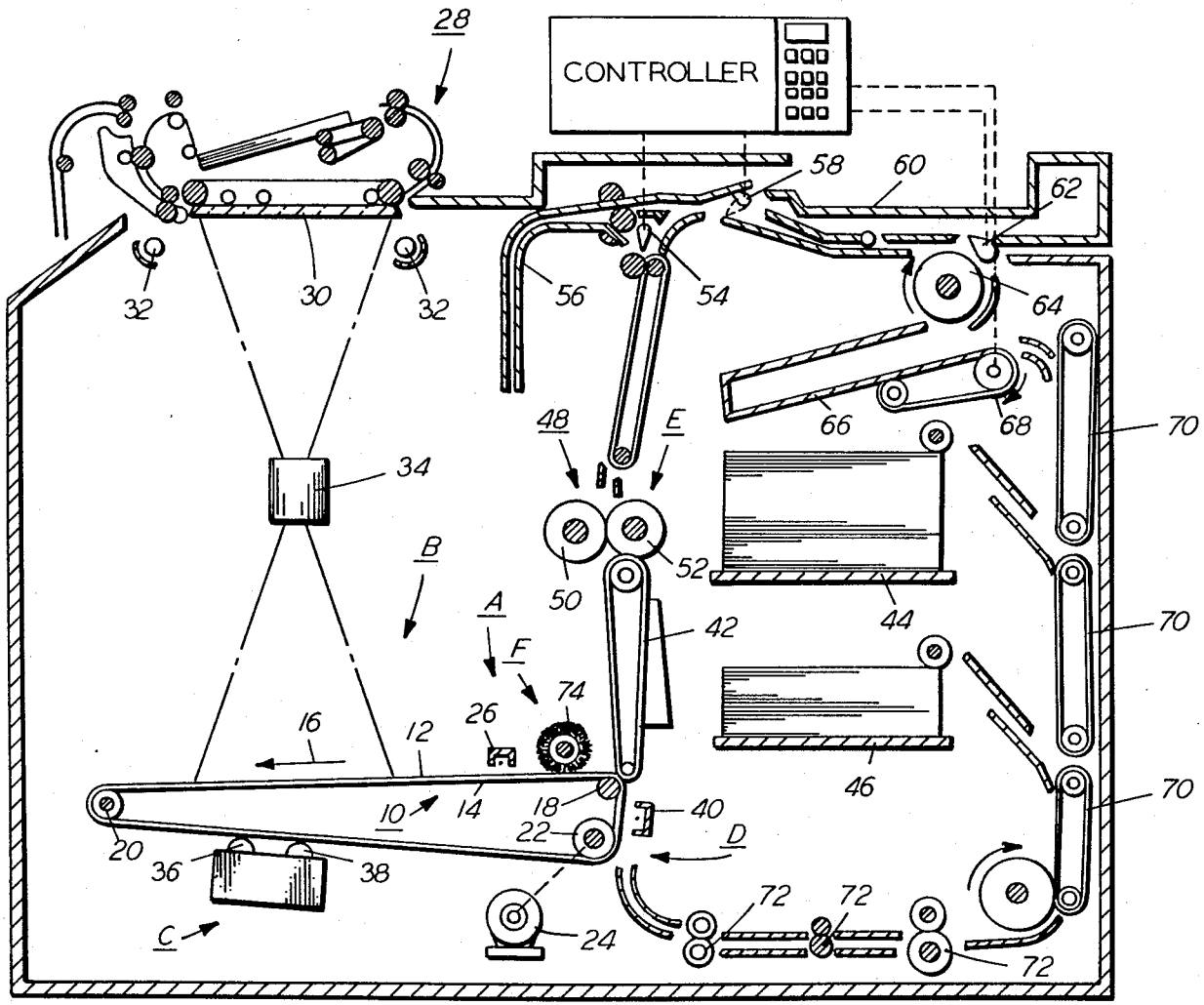
FIG. 1 is an elevational view depicting an electrophotographic printing machine incorporating with features of the present invention therein.

For a general understanding of the features of the present invention, references is made to the drawings. In the drawings, like reference numerals have been used throughout to designate identical elements. FIG. 1 schematically depicts the various components of an illustrative electrophotographic printing machine incorporating the fusing system of the present invention therein. It will become evident from the following discussion that the fusing system of the present invention is equally well suited for use in a wide variety of electrostatographic printing machines, and is not necessarily limited in its application to the particular printing machine shown herein.

Inasmuch as the art of electrophotographic printing is well known, the various processing stations employed in the FIG. 1 printing machine will be shown hereandafter schematically and their operation described briefly with reference thereto.

As shown in FIG. 1, the electrophotographic printing machine employes a belt 10 having a photoconductive surface 12 deposited on a conductive substrate 14.

Preferably, photoconductive surface 12 is made from a selenium alloy with conductive substrate 14 being made from an aluminum alloy. Other suitable photoconductive materials and conductives substrates may also be employed. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Stripping roller 18 is mounted rotatably so as to rotate with the movement belt 10. Tensioning roller 20 is resiliently urged against belt 10 to maintain belt 10 under the desired tension. Drive roller 22 is rotated by motor 24 coupled thereby suitable means, such as a drive belt. As roller 22 rotates, belt 10 advances in the direction of arrow 16.

Initially, a portion of photoconductive surface 12 passes through charging station A. At charging station A, a corona generating device, indicated generally by the reference numeral 26, charges photoconductive surface 12 to a relatively high, substantially uniform potential.

Next, the charged portion of photoconductive surface 12 is advanced through imaging station B. At imaging station B, a document handling unit, indicated generally by the reference numeral 28, is positioned over platen 30 of the printing machine. Document handling unit 28 sequentially feeds documents from a stack of document placed by the operator face down in a normal forward collating order in a document stacking and holding tray. A document feeder located, below the tray, forwards the bottom document of the stack to a pair of takeaway rollers. The bottommost sheet is then sent, by rollers through a document guide to a feed roll and conveyor belt. The conveyor belt advances the document onto platen 30. After imaging, the original document is fed from platen 30 by the conveyor belt into a guide and feed roll pairs which advance the document into an inverter mechanism, or back to the document stack through feed roll pairs. A decision gate is provided to divert the document either to the inverter or to the feeder roll pairs. Imaging of a document on platen 30 is achieved by lamps 32 which illuminate the document positioned thereon. Light rays reflected from the document are transmitted through lens 64. Lens 64 focuses the light image of the original document onto the charged portion of photoconductive surface 12 to selectively dissipate the charge thereon. This records an electrostatic latent image on photoconductive surface 12 which corresponds to the informational areas contained within the original document. Thereafter, belt 10 advances the electrostatic latent image recorded on photoconductive surface 12 to development station C.

With continued reference to FIG. 1, at development station C, a pair of magnetic developer rollers, indicated generally by the reference numerals 36 and 38, advance developer material into contact with the electrostatic latent image. The latent image attracts toner particles from the carrier granules of the developer material to form a toner powder image on photoconductive surface 12 of belt 10.

Belt 10 then advances the toner image powder to transfer station D. At transfer station D, a copy sheet is moved into contact with the toner powder image. Transfer station D includes a corona generating device 40 which sprays ions onto the backside of the copy sheet. This attracts the toner powder image from photoconductive surface 12 of belt 10 to the sheet. After transfer, conveyor 42 advances the copy sheet to a fusing station E.

The copy sheets are selected from one of the trays 44 or 46 and advanced to transfer station D by conveyor belts 70 and feed rolls 72. After transfer of the toner image powder to the first side of the copy sheet, the sheet is advanced by conveyor 42 to fusing station E.

Fusing station E includes a fusing system indicated generally by the reference numeral 48. Preferably, the fusing system includes a heated fuser roller 50 and a back-roller 52 with the toner image on the sheet contacting fuser roller 50. In this manner, the powder image is permanently affixed to the copy sheet. The detailed structure of fusing system 48 and the control scheme thereof will be described hereinafter with reference to FIGS. 2 through 5 inclusive.

After fusing, the copy sheets are fed to decision gate 54 which functions as an inverter selector. Depending upon the position of gate 54, the sheets will be deflected into a sheet inverter 56 or bypass inverter 56 and be fed directly to a second decision gate 58. The sheets which bypass inverter 56 turn a 90° corner in the sheet path before reacting gate 58. This inverts the sheets into a face up orientation so that the image side, which has been transferred and fused, is face up. If inverter path 56 is selected, the opposite is true, i.e., the last printed side is face down. The second decision gate 58 either deflects the sheet directly into an output tray 60 or deflects the sheets into a transport path which carries them on without inversion to a third decision gate 62. Gate 62 either passes the sheets directly on without inversion into the output path of the copier or deflects the sheets onto a duplex inverter roller 64. Roller 64 inverts and stacks the sheets to be duplexed in duplex tray 66 when gate 62 so directs. Duplex tray 66 provides intermediate buffer storage for those sheets which have been printed on one side in which an image will be subsequently printed on the side opposed thereto, i.e., the sheets being duplexed. Due to the sheets being inverted by roller 64, the sheets are stacked in tray 66 face down. The sheets are stacked in duplex tray 66 on top of one another in the order in which they are copied.

In order to complete duplex copying, the simplex sheets in duplex tray 66 are fed, in series, by bottom feeder 68 from tray 66 back to transfer station d for transfer of the toner powder image to the opposed side of the copy sheet. Conveyors 70 and rollers 72 advance the sheet along the path which produces an inversion thereof. However, inasmuch as the bottommost sheet is fed from duplex tray 66, the proper or clean side of the copy sheet is in contact with belt 10 at transfer station D so that the toner powder image on photoconductive surface 12 is transferred thereto. The duplex sheets are then fed through the same path as the simplex sheets to be stacked in tray 60 for subsequent removal by the machine operator.

Invariably, after the copy sheet is separated from photoconductive surface 12 of belt 10 some residual particles remain adhering thereto. These residual particles are removed from photoconductive surface 12 at cleaning station F. Cleaning station F includes a rotatably mounted fiberous brush 74 in contact with photoconductive surface 12 of belt 10. These particles are cleaned from photoconductive surface 12 of belt 10 by the rotation of brush 74 in contact therewith. Subsequent to cleaning, a discharge lamp (not shown) floods photoconductive surface 12 with light to dissipate any residual photostatic charge remaining thereon for prior to the charging thereof the next successive imaging cycle.

Controller 76 is preferrably a programmable microprocessor which controls all the machine functions. The controller provides the storage and comparison of counts of the copy sheets, the number of documents being recirculated in the document sets, the number of copy sheet selected by the operator, time delays, jam correction control, fuser temperature control, etc. The control of all of the systems in the printing machine may be accomplished by conventional control switch input from the printing machine console selected by the operator. Conventional sheet path sensors or switches may be employed for tracking or keeping track of the position of the documents and copy sheets. Controller 76 contains the necessary logic for regulating the temperature of fuser 48.

It is believed that the foregoing description is sufficient for purposes of the present invention to illustrate the general operation of an electrophotographic printing machine incorporating the features of the present invention therein.

Referring now to the specific subject matter of the present time. Invention, fuser 48 will be described with reference to FIG. 2 through 5 inclusive.

Figure 2:
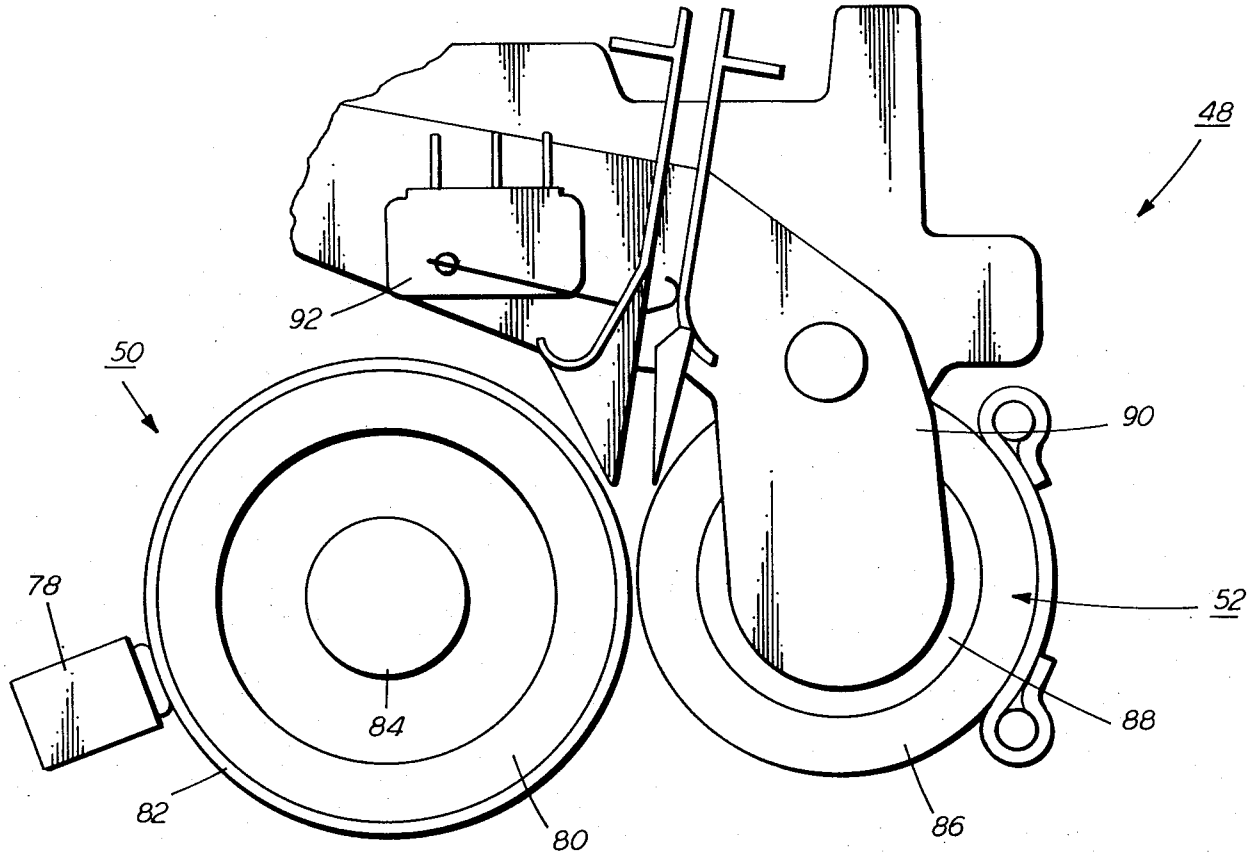
FIG. 2 is a fragmentary, elevational view depicting the fusing device used in the FIG. 1 printing machine.

As shown in FIG. 2, fuser 48 includes a fuser roller, indicated generally by the reference numeral 50, and a back-up roller, indicated generally by the reference numeral 52. A temperature sensor 78 contacts the exterior circumstantial surface of fuser roller 50.

Preferably, temperature sensor 78 is thermistor wherein the resistance thereof varies as a function of the detected temperature. The output signal from temperature sensor 78 is a voltage. Fuser roller 50 is composed of a hollow tube 80 having a thin covering 82 thereon. A heat source 84 is disposed interiorly of tube 80. Tube 80 is made from a metal material having the desired heat conductivity characteristics. By way of example, aluminum, copper and other metals having a high thermal conductivity are suitable for use as a tube. Preferrably, covering layer 82 is made from silicone rubber. Heating element 84 is preferrably a halogen lamp. Lamp 84 is connected to sensor 78 through controller 76. Back-up roller 52 has a relatively thick layer of silicone rubber 86 on metal tube 88. Back-up roller 52 is mounted rotatably on bracket 90. Bracket 90 is actuated by controller 76 to pivot so as to press back-up roller 52 into contact with fuser roller 50 to define a nip therebetween through which the copy sheet passes. Switch 92 detects the presence or absence of the copy sheet in fusing system 48 and indicates the status thereof to controller 76. Rollers 50 and 52 remain spaced from each other whenever fusing is not occurring. When fusing is occurring, roller 52 pivots so as to press against fuser roller 50. Back-up roller 52 and fuser roller 50 are adapted to rotate during the fusing operation so as to advance the copy sheet therethrough. Heat source 84, which may be a halogen lamp, or infrared lamp, amongst others, is located internally of fuser roller 80. During the operation of an internally heated fuser roller, the surface of the fuser roller experiences temperature variations which are due to the changes in the thermal load thereon. Temperature control is achieved through a proportional, resistor thermistor 78 coupled to control 76 which, in turn, regulates the heat output from heat source 84. Temperature variations occur as a result of the system going from a stand-by mode, wherein fuser roller 50 is at its stand-by temperature and back-up roller 52 is significantly cooler, to an operating or fusing mode, in which the copy sheet passes between the fuser roller and back-up roller at elevated temperatures. Large amounts of heat are transferred to the copy sheet and back up roller 52 during the fusing process. This drastically lowers the surface temperature of fuser roller 50.

Figure 3:
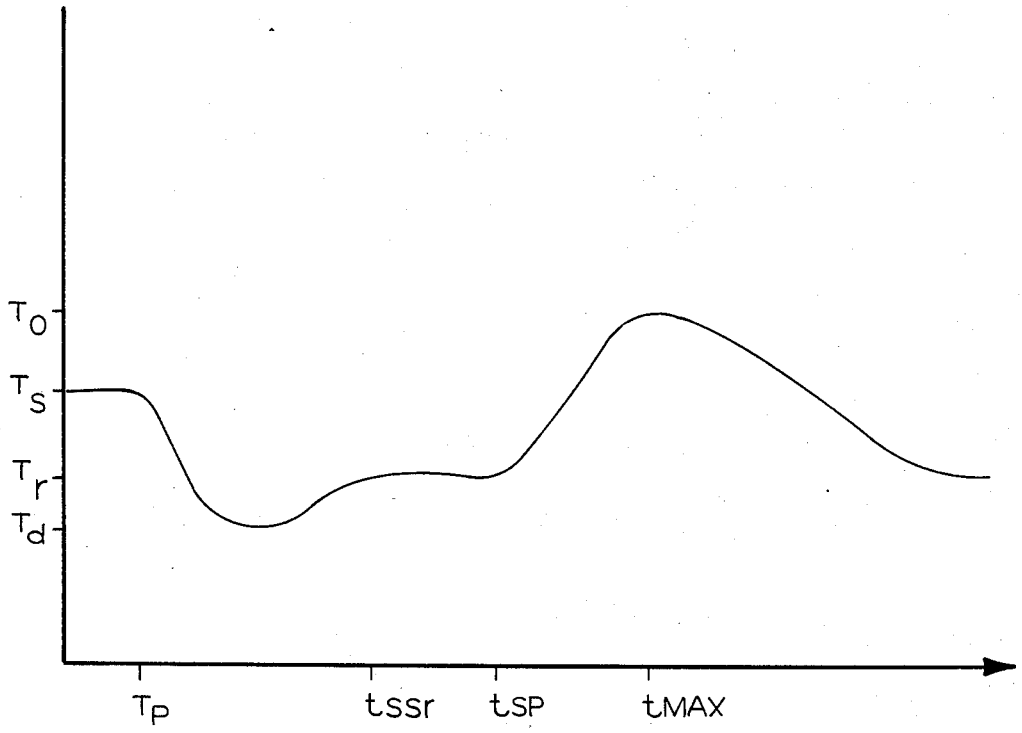
FIG. 3 is a graph showing the temperature variation of the center surface of the fuser roller used in the FIG. 2 fusing device without the control scheme of the present invention being employed.

Turning now to FIG. 3, there is shown a typical temperature cycle for fuser roller 50 when only being controlled in direct proportion to the voltage output from temperature sensor 78. A copy run is initiated at time, $t_p$, when the fuser roller surface is at its stand-by temperature $t_s$. As the fuser roller engages the back-up roller and a copy sheet passes through the nip therebetween, the surface temperature of the fuser roller drops below the intended steady state run temperature $T_d$. This droop is due both to the lags in the temperature controlling device and the thermal mass of the fuser roller core. As the system responds to these lags, the surface temperature of the roller increases to its operating or run temperature, $T_r$, at time $t_{ssr}$, and remains very close to this temperature until the end of the copy run, at $t_{sp}$. After completion of a copy run, due to the thermal energy stored in the fuser roller and the time lag in the temperature sensor, the surface temperature of the fuser roller overshoots the designed steady state stand-by temperature to $T_o$, at time $t_{max}$. At some later time, the temperature returns to the stand-by temperature, $T_s$. Operation of the fusing system in this manner is inefficient and may cause copy quality problems. If the operating latitude of the fusing system is limited, the copy sheets going through the fusing system at the start of the copy run may not be adequately fixed. On the other hand, temperature overshoots, at the end of the copy run, may increase the temperatures which the first few copies of the next successive copy run experience. This may lead to offsetting of the toner particles from the copy sheet to the fuser roller. These offset toner particles adhering to the fuser roller may be transferred to the next copy degradating the quality thereof. Thus, it is highly desirable to minimize the droop and overshoot temperature excursions during operation of the fusing system. This may be achieved by employing a control system which anticipates these excursion and adjusts the system to minimize their effects.

In order to minimize the droop and overshoot during a copy run, the fusing system controller must be able to anticipate the fuser roller surface temperature as a function of several parameters, i.e., the length of the copy run, the size of the copy sheet being employed, and the mode that the copy sheet is being operated in, i.e., simplex, duplex or computer forms feeding, etc. In addition to the foregoing, the control system must be able to anticipate the surface temperature variations during a particular run. In order to achieve this, the control logic must determine the magnitude of the first derivative of the temperature sensor voltage output with respect to time and compare this value with pre-determined boundary values throughout the copy run. Based on these values, the control system determines the heat output from the fuser roller heat source.

Figure 4:
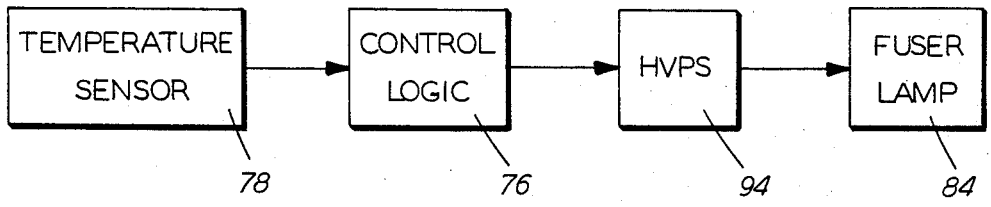
FIG. 4 is a block diagram illustrating the control system regulating the temperature of the FIG. 2 fusing device.

Referring now to FIG. 4, temperature sensor 78 develops a voltage output signal which is indicative of the measured surface temperature of the fuser roller. The voltage signal from the temperature sensor 78 is transmitted to controller 76. Controller 76 determines the time derivative of the voltage signal transmitted thereto. The time derivative of the voltage signal is compared to pre-determined boundary values. The boundary values are chosen through emperical means to correspond to the actual measured values of the rate of change of the fuser roller surface temperature. One of the boundary values is a pre-selected constant which is compared to the time derivative of the voltage from temperature sensor 78 at the beginning, or initialization, of the copy run. The other boundary value is a constant which is compared to the time derivative of the voltage from temperature sensor 78 at the end of the copy run. The decision of whether or not to energize fuser lamps 84 is made by comparing the stored constants with the time derivative of the voltage from temperature sensor 78. At the initialization of a copy run, the time derivative of the voltage from temperature sensor 78 is compared with the first constant or boundary value. If this constant is greater than the absolute value of the time derivative of the voltage, fuser lamp 84 remains off otherwise, fuser lamp 84 is energized. The constant is selected so that nominally, fuser lamp 84 will be energized at the beginning of a copy run, and, as such, is selected to be slightly less than the desired time derivative of voltage from temperature sensor 78. After a period of time, with fuser lamp 84 being energized, the surface temperature of the fuser roller increases and the time derivative of the voltage output from temperature regulator 78 decreases such that the time derivative is less than the constant. At this point, controller logic 76 defaults to the normal proportional control mode. At the end of the copy run, the system again calculates the time derivative of the voltage output from temperature sensor 78 and compares this with the second constant. If the second constant is greater than the absolute value of the time derivative, the fuser lamp is energized, otherwise the fuser lamp remains off. It is desirable to have the fuser lamp remain off immediately after completion of the copy run so that the surface temperature of the fuser roller does not excessively overshoot the stand-by condition. The second constant is chosen to achieve the foregoing. Controller 76 defaults to the normal proportional control mode once the surface temperature of the fuser roller is at the stand-by condition. Controller 76 determines the time derivative of the voltage from temperature sensor 78 by subtracting successive voltage measurements from temperature sensor 78 and dividing by the elapsed time therebetween. The output from controller 76 regulates the power output from high voltage power supply 94. High voltage power supply 94 is coupled to fuser lamp 84 and, dependent upon the input thereto, regulates the heat output therefrom.

Figure 5:
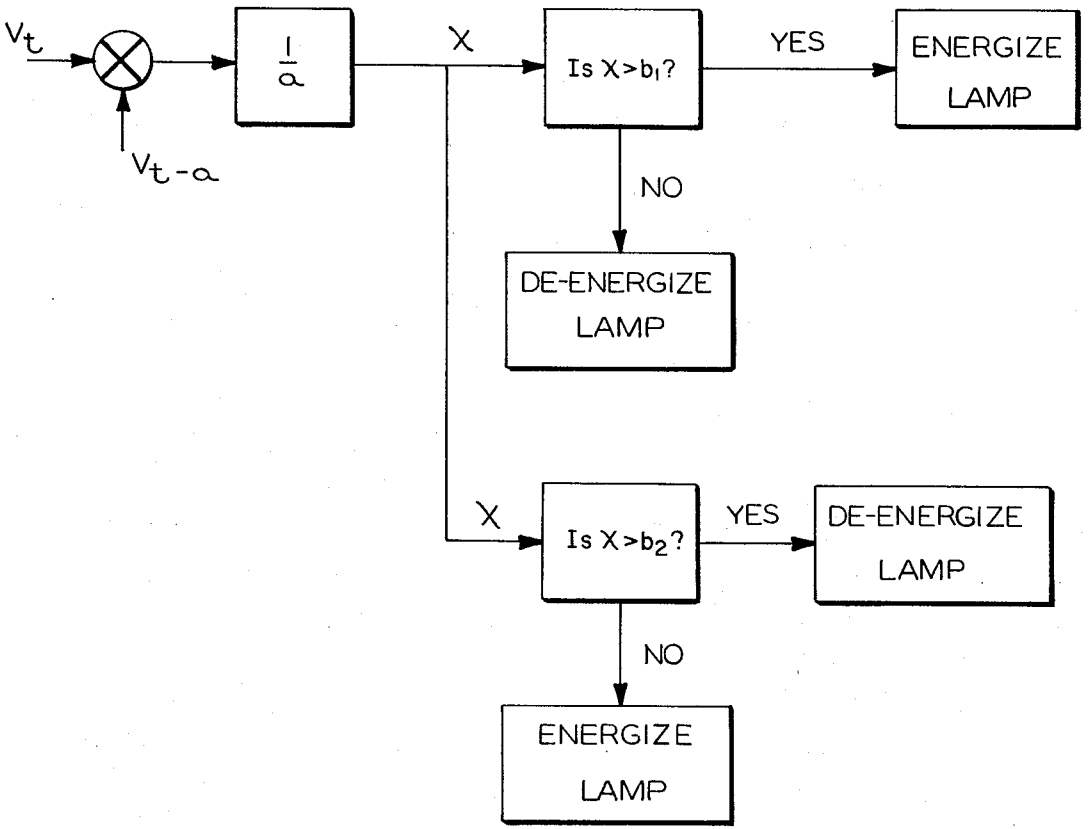
FIG. 5 is a flow diagram showing the control scheme employed by the control logic of FIG. 4.

Turning now to FIG. 5, there is shown a flow diagram describing the operation of the control scheme. As shown thereat, the temperature sensor voltage output $V_t$, time t, is compared to the temperature sensor voltage, $V_{t-a}$, at time t-a. The difference in the voltage outputs is then divided by a seconds, i.e. the time difference between the two voltage readings. This determines the time derivative of the voltage, $\chi$. The time derivative of the voltage, $\chi$, is then compared with constant, $b_1$, at the start of the copy run. If $\chi$, i.e. the time derivative of the voltage is greater than the constant, $b_1$, fuser lamp 84 is energized. Conversely, if $\chi$, i.e. the time derivative of the voltage output, is less than $b_1$, the fuser lamp is de-energized. At the end of the copy run, $\chi$, the time derivative of the voltage output, is compared to a second constant, $b_2$. If $\chi$, the time derivative of the voltage output, is greater than the second constant $b_2$, fuser lamp 84 is de-energized. Conversely, if $\chi$, the time derivative of the voltage output, is less than the second constant, $b_2$, fuser lamp 84 is energized. At all other times, the control system defaults to the normal proportional control.

In recapitulation, it is evident that the control system for the fusing devise of the present device minimizes temperature droops and overshoots at the surface of the fuser roller. The surface temperature of the fuser roller is regulated within specified temperature latitudes to insure that toner particles are not offset from the copy sheet to the fuser roller and to provide adequate heat for permanently affixing the toner particles to the copy sheet. This type of fusing control produces excellent, high quality copies.

It is, therefore, evident that there has been provided in accordance with the present invention a fusing system that fully satifies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications, and variations as fall within the spirit and broadscope of the appended claims.

I claim:

1. An apparatus for fusing images to sheets during a copy run, including:

means for applying heat to at least the images on successive sheets advanced, in seriatum, thereto for substantially permanently fixing the images to the sheets;

means for detecting the temperature of said heat applying means and transmitting a signal indicative thereof; and means for controlling said heat applying means, said controlling means comparing the time derivative of the signal received from said detecting means at initialization of the copy run to a first constant and energizing said heat applying means when the first constant is less than the time derivative of the signal, said controlling means comparing the time derivative of the signal received from said detecting means after the completion of the the copy run to a second constant and de-energizing said heat applying means when the second constant is less than the time derivative of the signal, and, after the time derivative of the signal is less than the first constant, said controlling means comparing the signal received from said detecting means during the copy run to a third constant and generating an error signal indicative of the difference therebetween to control said heat applying means.

2. An apparatus according to claim 1, wherein said heat applying means includes:

a heating member adapted to contact at least the images on successive sheets advanced, in seriatum, thereto; and means, in communication with said controlling means, for heating said heating member.

3. An apparatus according to claim 2, wherein said detecting means contacts the exterior surface of said heating member and generates a signal proportional to the temperature thereof.

4. An apparatus according to claim 3, wherein said heating member is a fuser roll.

5. An apparatus according to claim 4, further including a backup roll engaging said fuser roll to define a nip through which the sheets with the images thereon pass.

6. An apparatus according to claim 5, wherein said heating means includes:

at least one heating lamp disposed interiorly of said fuser roll; and a power supply coupled to said heating lamp and said controlling means.

7. An apparatus according to claim 3, wherein the signal transmitted from said detecting means is a voltage.

8. An electrophotographic printing machine of the type having a fusing apparatus for fusing toner powder images transferred to copy sheets during a copy run of the printing machine, wherein the improved fusing apparatus includes:

means for applying heat to at least the toner powder images on successive copy sheets advanced, in seriatum, thereto for substantially permanently fixing the toner powder images to the copy sheets;

means for detecting the temperature of said heat applying means and transmitting a signal indicative thereof; and means for controlling said heat applying means, said controlling means comparing the time derivative of the signal received from said detecting means at initialization of the copy run to a first constant and energizing said heat applying means when the first constant is less than the time derivative of the signal, said controlling means comparing the time derivative of the signal received from said detecting means after the completion of the copy run to a second constant and de-energizing said heat applying means when the second constant is less than the time derivative of the signal, and, after the time derivative of the signal is less than the first constant, said controlling means comparing the signal received from said detecting means during the copy run to a third constant and generating an error signal indicative of the difference therebetween to control said heat applying means.

9. A printing machine according to claim 8, wherein said heat applying means includes:

a heating member adapted to contact at least the toner powder images on successive copy sheets advanced, in seriatum, thereto; and means, in communication with said controlling means, for heating said heating member.

10. A printing machine according to claim 9, wherein said detecting means contacts the exterior surface of said heating member and generates a signal proportional to the temperature thereof.

11. A printing machine according to claim 10, wherein said heating member is a fuser roll.

12. A printing machine according to claim 11, further including a backup roll engaging said fuser roll to define a nip through which the copy sheets with the toner powder images thereon pass.

13. A printing machine according to claim 12, wherein said heating means includes:

at least one heating lamp disposed interiorly of said fuser roll; and of a power supply coupled to said heating lamp and said controlling means.

14. A printing machine according to claim 11, wherein the signal transmitted from said detecting means is a voltage.

* * * * *